US005579615A

United States Patent [19]

Hoffman

[11] Patent Number: 5,579,615

[45] Date of Patent: Dec. 3, 1996

[54] SECTIONAL STORM PANEL

[76] Inventor: Robert E. Hoffman, 5618 Riviera Dr., Coral Gables, Fla. 33146

[21] Appl. No.: 559,612

[22] Filed: Nov. 20, 1995

[51] Int. Cl.[6] ..... E06B 3/26

[52] U.S. Cl. ..... 52/202; 52/537; 49/464

[58] Field of Search ..... 52/202, 537, 783.11; 49/61, 62, 57, 464

[56] References Cited

U.S. PATENT DOCUMENTS

| | | | |
|---|---|---|---|
| 4,333,271 | 6/1982 | DePaolo et al. | 52/202 X |
| 5,426,893 | 6/1995 | Hoffman | 52/202 X |
| 5,487,244 | 1/1996 | Hill | 52/202 |

*Primary Examiner*—Carl D. Friedman
*Assistant Examiner*—Timothy B. Kang
*Attorney, Agent, or Firm*—Harness, Dickey & Pierce, P.L.C.

[57] ABSTRACT

A sectional storm panel is made of numerous corrugated sections arranged edge to edge, with their adjacent edges overlapped. The sections are substantially identical in size and shape and are formed of a thin sheet which is corrugated in the vertical direction. The corrugations are each formed in the shape of truncated triangles, which alternatingly, open towards an outer face and an inner face of the panel. The opposite edges of each panel are provided with integral flanges of approximately the size of the corrugation small bases. The flange on one section overlaps the adjacent flange of the next section. Each of these flanges are provided with a centrally located, V-shaped groove which extends vertically along the flange. The grooves on each pair of overlapped flanges open in the direction towards the inner face of the panel and are vertically aligned. Thus, the forces resulting from an impact against the outer face of the panel are partially absorbed by the angled walls of the corrugation near the place of impact and, in addition, the portions of the overlapped flanges, near the place of impact, buckle inwardly by folding along their aligned vertical grooves, without substantial separation of the impacted overlapped flange portions.

13 Claims, 2 Drawing Sheets

FIG-6
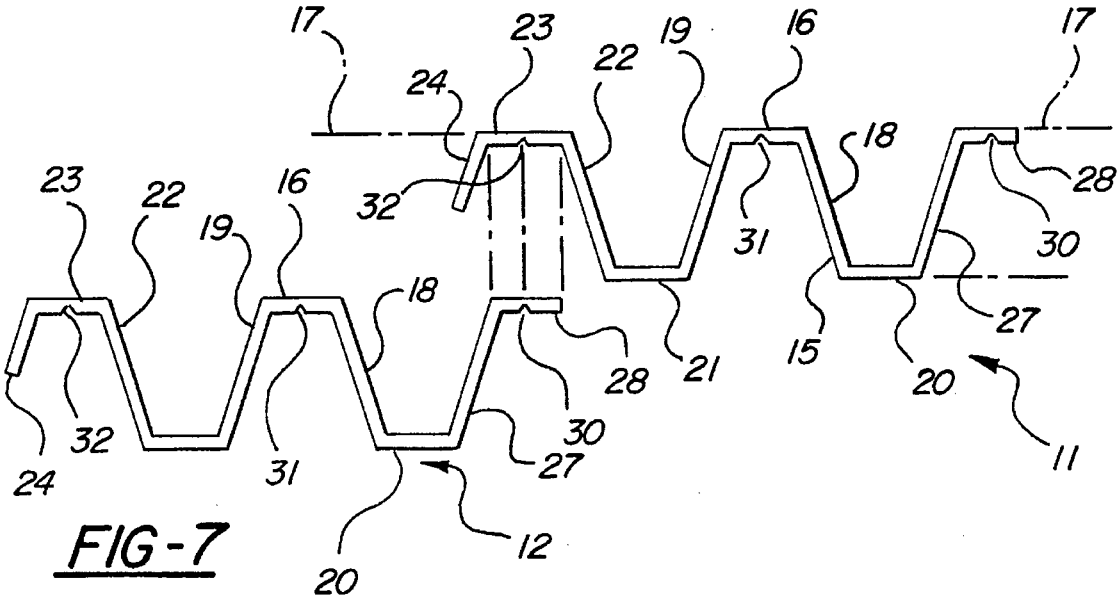
FIG-7
FIG-8
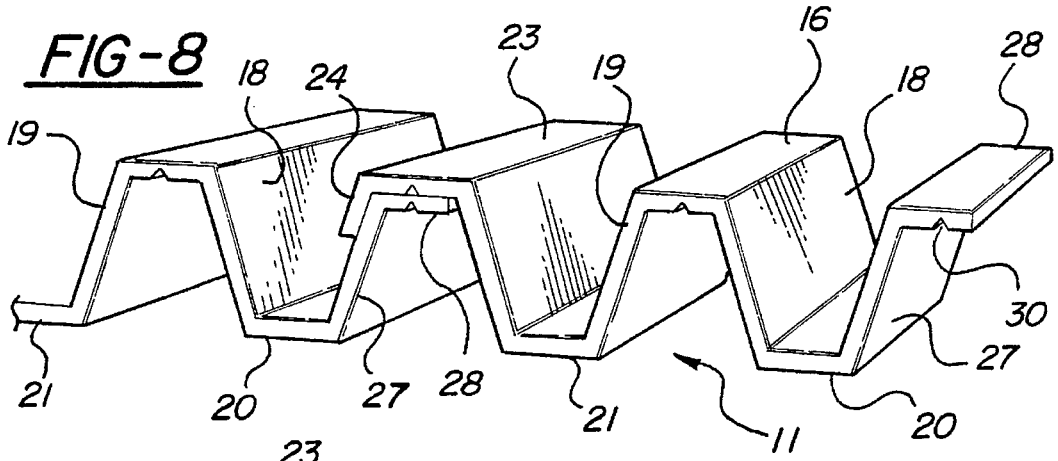
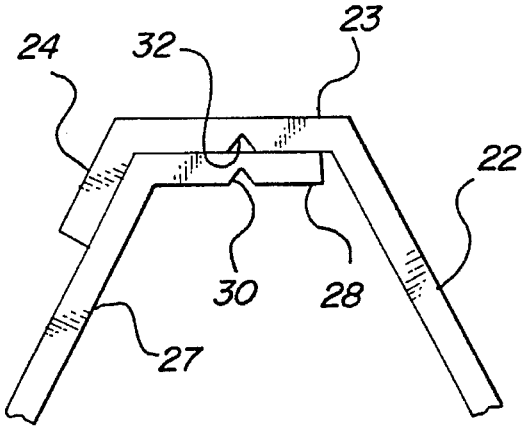
FIG-9
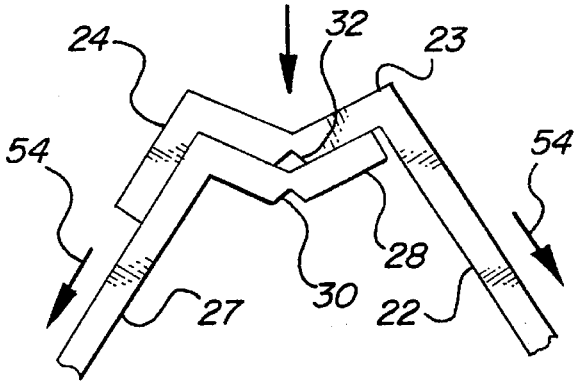
FIG-10

SECTIONAL STORM PANEL

BACKGROUND OF INVENTION

This invention relates to an improved storm panel of the type which is made of aligned sections that are connected together edge to edge and which is used to cover window and doorway openings of a building to protect the building against penetration by wind hurled objects or objects which are forcefully applied manually.

In areas where high wind storms, such as hurricanes and the like, occur from time to time, it is conventional to cover openings in a building with protective panels when storm warnings are received. One form of such protective panels comprises a large, monolithic, planar cover or sheet made of metal or wood. Another form of such protective panels is made of horizontally arranged slats that are connected together edge to edge so that the panels may be rolled out of the way, above the opening, when they are not needed and rolled down into a planar configuration when needed. Still another form of such panels comprises vertically elongated flat or corrugated sections, which are made of sheet metal or plastic sheet, that are connected together edge to edge, when needed, to form a composite panel for positioning over a building opening. The invention herein relates to the latter form of panels.

Where storm panels are formed of an assembly of a number of separate sections, it is conventional to align the sections in a generally coplanar arrangement and to connect their adjacent edges together. The connections may be temporary so that they may be released when the panel is to be disassembled and the sections are stored until needed to form the composite panel.

These composite panels that are assembled in advance of a storm and disassembled after a storm, must be capable of resisting not only wind pressure, but also substantial impacts from wind-hurled debris, such as pieces of wood, parts of buildings, etc. Thus, the sections must be made of a suitably strong material, such as sheet metal which may be corrugated to increase its strength or may have additional strengthening ribs or strips secured thereto for strengthening the panel. In general, the weakest portions of such panel assemblies can be along the edges of the sections where they are connected together. These edges may separate under sufficient impact forces. Such separation can permit penetration of the panel by rapidly moving, wind hurled debris or by manually applied, forceful impacts that could occur where the panel is used to cover and protect a building opening against penetration for security reasons rather than for storm protection reasons. Prior sectional or composite panels, in general, have a relatively low threshold of resistance to penetration and their section edges tend to separate in response to substantial impacts.

Thus, there has been a need for sectional type protective panels which have sufficient strength to resist penetration and, particularly, to resist separation of the connected edges of the sections when the panel is subjected to severe impacts. The invention herein relates to an improvement in the construction and in the connections between the sections forming a composite protective panel to substantially increase the strength of the panel and the resistance of the panel assembly to separation of adjacent section edges due to impacts.

SUMMARY OF INVENTION

This invention contemplates a storm protection panel formed of numerous, vertically elongated panel sections which are aligned in a generally co-planar arrangement and are connected together edge to edge. The sections are substantially identical in size and shape and, in general, are formed with vertically extending corrugations which may be rolled into the sheet metal or sheet plastic material out of which the sections are constructed. The corrugations are each formed in a substantially truncated triangular cross-sectioned shape whose small or narrow bases, form vertical bands arranged alternatively on the opposite faces of the panel.

The truncated, triangular shaped corrugations are shaped similarly to the surfaces of the frustum of a hollow cone. That is, each truncated, triangular shape has a wide base which opens towards either the outer surface or the inner surface of the panel. Preferably, the sections are provided with a center corrugation whose narrow base is arranged in the plane of the outer face of the panel and a pair of side corrugations whose narrow or smaller bases are arranged in the plane of the inner face of the panel. The free elongated leg or wall of each of the side corrugations terminates in a flange which is the size and shape of a narrow base located approximately in the plane of the narrow base of the center corrugation. One of these flanges has a bent angled leg. The other flange is located slightly inwardly of the plane of the outer face of the panel.

When the panel is assembled for use, the sections are arranged so that their adjacent flanges overlap, with the flange that is located inwardly of the outer plane arranged within and in face-to-face contact with the next flange that has the integral angle leg formed thereon. Thus, the adjacent edge flanges, which are overlapped in face-to-face contact, form a double thick, vertical band at the connection or joint between each adjacent pair of sections. Each of the approximately co-planar flanges and narrow or small corrugation bases is provided with a centrally located, vertically extending V-shaped groove which opens in the direction of the inner face of the panel. The grooves of each pair of overlapped flanges are in substantial vertical alignment.

It is also contemplated to mechanically fasten the overlapped flanges together near the upper and lower edges of the panel without necessarily fastening together the overlapped portions between the upper and lower fastenings. The upper and lower edge portions of the assembled panel may be arranged within channel-shaped tracks that are secured upon the header structure and the sill structure of the building opening.

The angled arrangement of the legs forming the truncated triangle shape of the corrugations serve to absorb the forces resulting from an impact against the outer surface of the assembled panel. Further, upon impact against the outer surface, the impacted areas of the overlapped flanges, as well as the narrow bases that are impacted, tend to fold inwardly along their vertical grooves. This action tends to absorb the forces of impacts and to preclude any substantial separation of the overlapped flanges.

An object of this invention is to provide a sectional panel construction with a penetration-resistant and separation-resistant connection between each of the panel sections so as to preclude penetration of the panel, particularly, through the connected edges of adjacent sections, by wind-hurled objects or by manually, forcefully applied, objects.

A further object of this invention is to substantially reinforce the connections between adjacent sections forming a composite storm panel in a manner which is simple in construction, inexpensive to produce, easy to manually assemble and disassemble when necessary for storm panel use and, particularly, which resists separation of the connected section edges by forces from severe impacts.

Still another object of this invention is to provide reinforced, penetration-resistant, joints between adjacent sections of an easily assemblable and disassemblable composite protective panel for building openings.

These and other objects and advantages of this invention will become apparent upon reading the following description, of which the attached drawings form a part.

DESCRIPTION OF DRAWINGS

FIG. 6 is an end view of a panel section, and

FIG. 7 is an end view of a second panel section aligned with and ready to be assembled against the section illustrated in FIG. 6.

FIG. 8 is a perspective view of a fragment of a pair of overlapped, assembled sections.

FIG. 9 is an enlarged, end view of the overlapped flanges of a pair of adjacent sections, and FIG. 10 is a view similar to FIG. 9 but with the overlapped flanges buckled under an impact.

DETAILED DESCRIPTION

Figure 1:
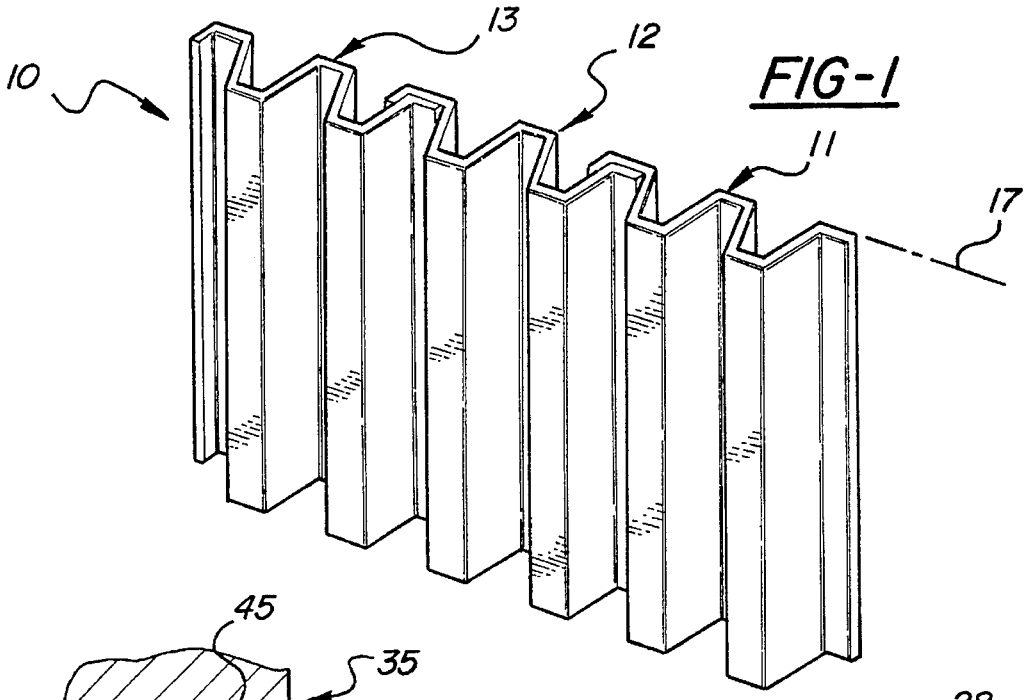
FIG. 1 is a perspective, fragmentary view of a portion of a composite storm panel formed of a number of sections joined together edge to edge.

FIG. 1 illustrates a storm panel 10 formed of a number of sections 11, 12 and 13 which are aligned in a common vertical plane and joined together edge to edge. The panel is a composite or assembly of numerous sections. However, for illustration purposes, only three sections are shown.

The sections are each substantially identical in construction. Basically, they are formed of relatively thin, but rigid, sheets of metal, although for some purposes plastic sheets may be used. These sheets are corrugated vertically. Thus, each sheet is approximately in the shape of a vertically elongated rectangle with vertically extending corrugations. As will be described below, each of the corrugations is formed in the shape of a truncated isosceles triangle. Described otherwise, each corrugation is in the shape of the cross-section of the outer surface of a frustum of a cone.

Each section is provided with a center truncated triangle corrugation 15 having a narrow or small base 16 arranged in the plane of the outer face 17 of the panel. A pair of angled legs or walls 18 and 19 are integral with the base 16 to complete the truncated isosceles triangular formation.

Each of the angled legs are integral with small or narrow bases 20 and 21 respectively which bases are located in the plane of the inner face of the panel. Base 21 is extended into an integral angled leg or wall 22 which is bent into a narrow base 23 that is arranged in the plane of the outer face of the panel. Base 23 terminates in an angled flange 24 which extends partway towards the inner face of the panel at an angle corresponding to the angles of the legs of the triangles.

The base 20 extends into an angled leg 27 directed towards the outer face of the panel. However, this leg is slightly shorter in length than the other legs or walls and terminates in a flange forming a base 28. This flange or base is parallel to, but is spaced slightly inwardly of, the outer face plane 17 (see FIG. 6).

Preferably, each single panel section is formed of a center corrugation and a pair of side corrugations that are each of substantially the same shape and size. However, additional side corrugations may be formed in each section, so that the sections are wider. The shapes and sizes may vary. An example of this construction would be narrow or small bases that are about 1" wide, with the open space or wide bases between the opposite ends of the legs being slightly greater than 2" wide. The altitudes of the truncated triangles would be about 2" and the legs of the triangles would be on the order of about 15°–16°. These dimensions, of course, can be varied considerably. But the general relationship of the sizes and angles assist in the rigidification of the panel section and thus, the specific dimensions should be designed with the thickness and nature of the material, and threshold impact forces considered. An example of the wall thickness of the metal sheet, which may be aluminum sheet, is about 0.068" thick. The overall width of each panel section could be on the order of 7.7" and the height of the sections corresponds to the height that is needed for a particular window or door opening. The foregoing dimensions are given for illustrative purposes.

Each of the inner surfaces of the small bases 16, and flanges 23 and 28 is provided with a V-shaped groove which extends the full height, that is, the vertical length of the sections and is approximately centered on the particular base or flange. The grooves open towards the inner face of the panel.

Figure 2:
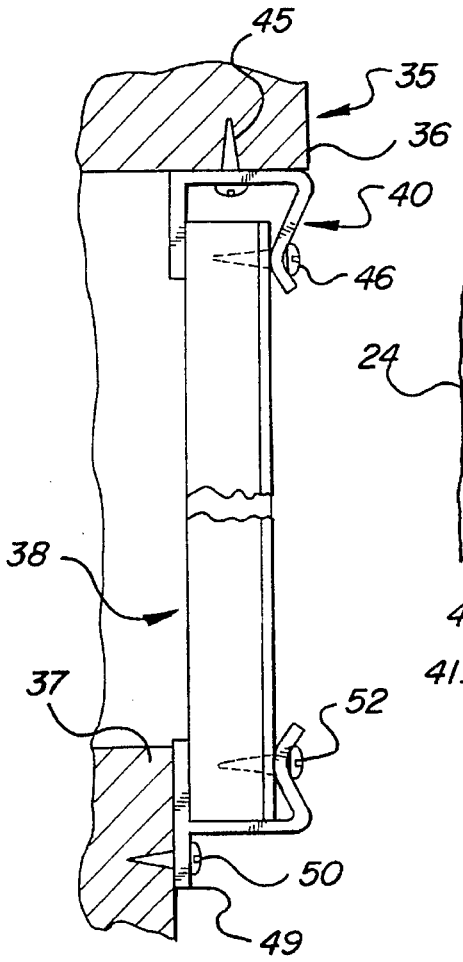
FIG. 2 is a fragmentary, elevational, end view of the panel mounted within header sill channels attached to a building structure.
Figure 3:
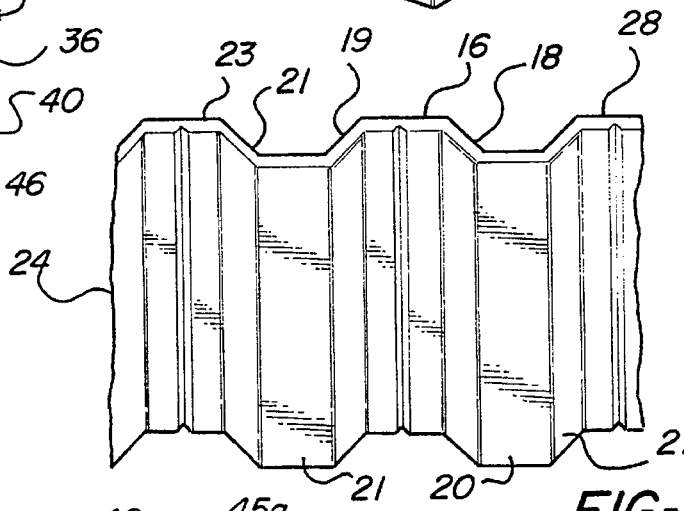
FIG. 3 is a fragmentary, perspective view of a portion of the inner surface of a panel section.
Figure 4:
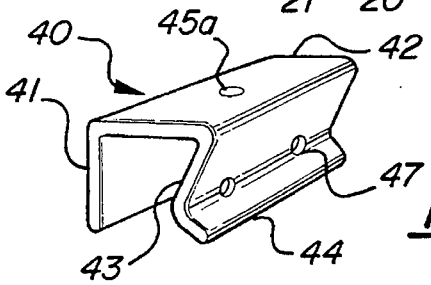
FIG. 4 is an end, perspective view of a portion of an upper or header channel.

Normally, the panel sections may be stored by stacking them one upon the other in nesting arrangement, until the panel is needed for protection purposes. When the panel is needed, either for storm protection or for protection against unwanted entry, the sections are assembled into the composite panel. For this purpose, the flange base 28 of each section is positioned against the inner surface of the base 23 of the next adjacent section. That aligns all the sections into the planar panel shape. The sections are positioned within upper and lower supporting tracks or channels. Thus, as illustrated in FIG. 2, the structure 35, in which a building opening is formed, is provided with a header portion 36, a sill portion 37 and jamb portions 38. These define a building opening, such as a window opening or a doorway. An upper track channel 40 (see FIGS. 2 and 4)is provided to receive and hold the upper edge of the panel. This channel 40 is formed of a metal extrusion in the shape of a wall 41, an integral base 42 and an integral wall 43 having an angled guide flange 44. The channel may be fastened by screws 45 into the header portion of the building structure. To assist in that assembly, pre-punched holes **45*a* may be provided in the base 42**.

The upper edge portions of the sections at their overlapped edges, may be mechanically fastened together and to the upper channel 40 by means of screws 46 extending through the wall 43 of the channel. To assist in this assembly, screw holes 47 may be pre-punched or drilled in the channel 40. Alternatively, the screw holes may be eliminated and the screws simply driven through the channel wall into the underlying section portions.

Figure 5:
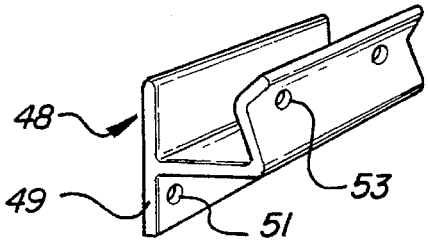
FIG. 5 is an end, perspective view of a lower or sill channel.

A lower track channel 48 is provided to receive the lower edge of the panel (see FIGS. 2 and 5). This channel is similar in construction to the upper track channel except that it may also be provided with an integral mounting flange 49 which may be fastened by screws 50 into the building structure at the sill. Holes 51 may be formed in the mounting flange 49 to guide the location of the screws. Otherwise, the lower track and the upper track are similar in cross-sectional shape except that one is inverted relative to the other. As an alternative, both channels may be identical in cross-section, either with or without the mounting flange 49, depending upon the particular building structure to which they are to be connected.

To hold the sections together and within the lower channel, screws 52 may be applied through the lower channel wall and into the adjacent overlapped section flanges. For this purpose, screw holes 53, may be provided or, alternatively, the screws may be driven directly through the metal of the channels into the underlying section portions.

In operation, upon receipt of a storm warning, a building manager or owner or maintenance person may assemble the sections together, supported within the upper and lower tracks, to form the composite protective panel. When no longer needed, after the storm, the panel may be disassembled and the sections stacked for storage purposes. In the event that debris is hurled by high wind forces, against the panel, the forces of the impact will be absorbed by the angularly arranged legs, as illustrated by the arrows 54 in FIG. 10. In addition, the overlapped flanges will fold, as illustrated in FIG. 10, to absorb impact forces. Similarly, the bases 16 will fold under impact. The buckling or folding action tends to hold the flanges together to resist separation because of the impact. While a small amount of separation of the overlapped flanges may be acceptable, such as on the order of ⅛" separation or less, any substantially larger separation of the flanges is unacceptable because of the danger of penetrating the joint with the forcefully applied object. Thus, this construction prevents any substantial separation.

While the panel described herein is essentially designed to resist storm damage, the panel is also useful for sealing or blocking openings into buildings to prevent unwanted entry or unwanted penetration. Thus, the specific sizes and shapes of the sections described above may be modified to provide the strength necessary to resist a predetermined threshold impact, whether of the storm debris type or manually applied type.

This invention may be further developed within the scope of the following claims. Accordingly, having described an operative embodiment of this invention, I now claim:

1. A sectional storm panel formed of a number of substantially identical, vertically elongated, narrow sections whose adjacent edges are overlapped to form a composite panel having an outer face and an inner face and being of a size to cover an opening in a building, such as a window or doorway opening and the like, comprising:

each section being made of a thin, rigid, vertically corrugated sheet that is formed, in cross-section, in the shape of a series of substantially identical, truncated isosceles triangles, whose small bases are integral with the angled sides thereof, and whose large bases are open, to form channels alternatingly opening towards opposite faces of the panel;

and with one elongated vertical side edge of each section terminating in a first flange similar to a small base, along the outer face of the panel, and having an integral, angled side leg which extends towards and terminates a distance from the section inner face and with opposite vertical side edge of the section terminating in a second flange similar to a small base and arranged along the outer face of the panel, and with the second flange being dimensioned to closely fit within the angled side leg and adjacent the inner surface of the first flange of an adjacent section for overlapping adjacent side flanges of adjacent sections and with overlapped flanges being substantially in full face-to-face contact;

and each of the overlapped flanges of the adjacent sections having a central groove formed along its inner surface and extending the length thereof, with the grooves being centrally arranged along said flanges so that the grooves of each pair of overlapped flanges are substantially aligned along the height of the panel sections;

and the overlapped flanges of adjacent sections being connected together by mechanical connectors, such as screws and the like near the upper and lower edges of the panel;

whereby forces from an applied impact against a portion of the outer surface of the panel tend to be absorbed by the adjacent portions of the angled sides of the truncated triangles and the adjacent portions of the overlapped flanges thereof, and cause the portions of the overlapped flanges which receive such impact to buckle inwardly by generally folding along their respective overlapped grooves while avoiding any substantial separation between the overlapped flanges.

2. A sectional storm panel as defined in claim 1, and said second flange of each panel being of a size to extend substantially the full width of, and being arranged in the plane of the inner surface of the first flange of an adjacent section.

3. A sectional storm panel as defined in claim 2, and including an upper header channel and a lower sill channel mounted upon the structure forming the header and sill portions of said opening for receiving the upper and lower edges of the panel and, thereby, holding the panel in position over said opening.

4. A sectional storm panel as defined in claim 1, and with the cross-sectional lengths of the sides of the truncated triangular corrugation shapes of the sections being greater than twice the widths of the small bases thereof.

5. A construction as defined in claim 4, and the widths of the open, large bases of the truncated triangular shapes being roughly no less than the height of the truncated triangular shapes.

6. A construction as defined in claim 4, and with the width of the open, large bases of the truncated triangular shapes being slightly larger than the altitudes of the truncated triangular shapes.

7. A construction as defined in claim 1, and said grooves in the flanges being generally V-shaped in cross-section.

8. A construction as defined in claim 1, and including grooves formed in the inner surfaces of each of the small bases located at the outer surface of the panel, and with each of said grooves being V-shaped in cross-section and extending the full height of the panel sections.

9. In a sectional storm panel formed of a number of substantially identical, vertically elongated sections arranged with their adjacent edges overlapped to form a composite panel having an outer face and an inner face, and with the panel having upper, lower and side edges sized to cover an opening in a building and the like for protecting against impacting objects directed towards said opening, and with upper and lower members on the building structure engaging and holding the upper and lower edges of the panel upon the building structure, the improvement comprising:

each section being formed with a number of vertical corrugations shaped in cross-section as alternating, truncated isosceles triangles which alternatively open at their large bases towards the outer and inner faces of a panel;

a center truncated triangular corrugation having its small base in the plane of the outer face of the panel and opposite side edge truncated triangle corrugations having their small bases in the plane of the inner face of the panel;

and with side edges of one of the side triangle corrugations having a first flange portion arranged in the plane of the outer face of the panel and terminating in an angled flange which extends part way toward the inner face of the panel and is angled at substantially the same angle as the angles of the walls of the truncated triangle extend from the bases;

and with a side edge of the wall of the truncated triangle corrugation at the opposite edge of the section terminating in a second flange which is substantially in the plane of the inner face of the panel, and is of a width to closely fit, in substantially face-to-face overlapping contact, against the inner surface of the first flange of an adjacent section;

and with the overlapped flanges each having a groove formed in its inner surface, with the groove extending substantially the full length of the respective section, and with the grooves of the overlapped flanges being substantially aligned with each other, and with the grooves opening in the direction towards the inner face of the panel;

whereby forces resulting from an impact directed against the outer surface of the panel tend to be absorbed, in part, by the portions of the angled sides of the truncated triangle corrugations adjacent to the location of the impact and by the adjacent portions of the overlapped flanges which receive such impact, causing the flange portions to buckle inwardly by generally folding along their vertically extending grooves to preclude any substantial separation between said portions of the overlapped flanges.

10. A construction as defined in claim 9, and wherein said grooves are V-shaped in cross-section and open in the direction of the inner face of the panel.

11. A construction as defined in claim 9, and wherein the lengths of the sides of the truncated triangular corrugations of the sections are generally at least twice the width dimension of the small bases thereof.

12. A construction as defined in claim 11, and wherein the dimensions of the widths of the large bases of the truncated triangular shapes are generally slightly greater than the altitudes of the truncated triangular shapes.

13. A construction as defined in claim 12, and including mechanical fasteners, such as screws and the like, fastening together the overlapped flanges of the adjacent sections at the upper and lower edges of the panel, with the portions of the overlapped flanges between said upper and lower fasteners being free of mechanical attachment to each other.

* * * * *